US009999265B2

(12) United States Patent
Monardo

(10) Patent No.: US 9,999,265 B2
(45) Date of Patent: Jun. 19, 2018

(54) ADJUSTABLE PRIVACY GOWN

(71) Applicant: Joanne P. Monardo, Incline Village, NV (US)

(72) Inventor: Joanne P. Monardo, Incline Village, NV (US)

( * ) Notice: Subject to any disclaimer, the term of this patent is extended or adjusted under 35 U.S.C. 154(b) by 145 days.

(21) Appl. No.: 15/082,795

(22) Filed: Mar. 28, 2016

(65) Prior Publication Data

US 2016/0278456 A1 Sep. 29, 2016

Related U.S. Application Data

(60) Provisional application No. 62/139,025, filed on Mar. 27, 2015.

(51) Int. Cl.
*A41D 13/12* (2006.01)

(52) U.S. Cl.
CPC .... *A41D 13/1236* (2013.01); *A41D 2300/324* (2013.01)

(58) Field of Classification Search
CPC .... A41D 13/1245; A41D 13/129; A41D 1/20; A41D 11/00; A41D 13/1236; A41D 10/00; A41D 13/04; A41D 13/12; A41D 1/21; A41D 15/00; A41D 3/08; A41D 1/22; A41D 1/18; A41D 2300/30; A41D 2300/324
USPC ..... 2/114, 48, 75, 51, 52, 70, 105; D2/720, D2/740, 757, 861
See application file for complete search history.

(56) References Cited

U.S. PATENT DOCUMENTS

| | | | | |
|---|---|---|---|---|
| 776,054 | A | 11/1904 | Glover | |
| 1,489,046 | A * | 4/1924 | Thompson | A41B 9/08 2/114 |
| 1,521,228 | A * | 12/1924 | Clamage | A41D 1/22 2/48 |
| 1,582,385 | A | 4/1926 | Dauphinais | |
| 2,212,719 | A * | 8/1940 | Prouty | A41D 13/1209 2/93 |
| D137,290 | S | 2/1944 | Waters | |
| D170,156 | S | 8/1953 | Hagan | |
| 2,768,383 | A | 10/1956 | DeWitt | |

(Continued)

OTHER PUBLICATIONS

Spector, Kaye, "Designer Diane Von Furstenberg Helps Clinic to Design New Hospital Gown", Cleveland.com, Retrieved At: «http://blog.cleveland.com/health_impact/print.html?entry=/2010/09/designer_diane_von_furstenberg.html», Sep. 7, 2010, 3 pages.

(Continued)

*Primary Examiner* — Amy Vanatta
(74) *Attorney, Agent, or Firm* — Medley, Behrens & Lewis, LLC; Lorri W. Cooper

(57) ABSTRACT

A privacy gown includes a first panel, a second panel, and a plurality of connectors. The second panel has a different size and shape from the first panel. The plurality of connectors is coupled to both the first and the second panels for removably and fixedly coupling the first and second panels together in an assembled position. The second panel has a portion with a width that is greater than a width of the first panel along at least part of a length of the second panel. The second panel overlaps the first panel along the sides thereof when in an assembled position. The second panel has at least two different width positions for fixing the width of the privacy gown during use.

18 Claims, 9 Drawing Sheets

(56) References Cited

U.S. PATENT DOCUMENTS

| | | | | |
|---|---|---|---|---|
| 3,116,491 | A * | 1/1964 | Previdi | A41D 1/20 2/102 |
| 3,276,036 | A * | 10/1966 | Cater | A41D 13/1236 2/114 |
| 3,350,720 | A * | 11/1967 | Freund | A41D 13/04 2/48 |
| 4,055,855 | A | 11/1977 | Ragone et al. | |
| 4,258,440 | A * | 3/1981 | McGowan | A41D 13/1236 2/114 |
| D279,040 | S | 6/1985 | Horox | |
| 4,612,673 | A * | 9/1986 | Underhill | A41D 13/1236 2/114 |
| 4,622,699 | A | 11/1986 | Spriggs | |
| 4,920,578 | A | 5/1990 | Janzen et al. | |
| 5,150,477 | A | 9/1992 | Elberson et al. | |
| D350,012 | S | 8/1994 | Christy et al. | |
| D374,970 | S | 10/1996 | Jagger | |
| D378,157 | S | 2/1997 | Jagger | |
| 5,991,923 | A | 11/1999 | Maria | |
| D457,289 | S | 5/2002 | Shorr | |
| 6,564,386 | B2 | 5/2003 | Fujikawa et al. | |
| D495,468 | S | 9/2004 | Wheeler-Dickson et al. | |
| 6,792,622 | B2 * | 9/2004 | Graves | A41D 13/1245 2/114 |
| 7,305,716 | B1 | 12/2007 | Richards | |
| D574,126 | S | 8/2008 | McCray | |
| 7,424,750 | B2 | 9/2008 | Kerr | |
| 7,942,856 | B2 | 5/2011 | Lentini | |
| 8,196,223 | B2 | 6/2012 | Hamilton et al. | |
| 8,332,965 | B1 | 12/2012 | Ryer | |
| 2003/0126668 | A1 | 7/2003 | Scroggins | |
| 2005/0132465 | A1 | 6/2005 | Kathumbi-Jackson et al. | |
| 2006/0277655 | A1 * | 12/2006 | Kerr | A41D 13/1236 2/114 |
| 2007/0289046 | A1 | 12/2007 | Sauchelli | |
| 2010/0242150 | A1 | 9/2010 | Trouillot | |
| 2011/0186057 | A1 | 8/2011 | Hatton | |
| 2012/0204317 | A1 | 8/2012 | Bolla | |
| 2013/0007942 | A1 | 1/2013 | Lucas | |
| 2013/0276202 | A1 | 10/2013 | Forbes et al. | |
| 2014/0026289 | A1 | 1/2014 | Schulties | |
| 2014/0058485 | A1 | 2/2014 | Augustine et al. | |
| 2014/0173803 | A1 | 6/2014 | McCollum et al. | |
| 2014/0189931 | A1 | 7/2014 | Fredrickson | |
| 2015/0272240 | A1 * | 10/2015 | Smith | A41D 15/00 2/69 |

OTHER PUBLICATIONS

"Hospital Gown", Wikipedia, Retrieved At: «https://en.wikipedia.org/wiki/Hospital_gown», Retrieved Date: May 19, 2016, 4 pages.

"Model G Patient Gown", Innovating the Future of Human Health, Retrieved At: «http://henryfordinnovation.com/about/model-g-patient-gown/», Nov. 30, 2015, 19 pages.

* cited by examiner

ADJUSTABLE PRIVACY GOWN

CROSS-REFERENCE TO RELATED APPLICATIONS

This application claims priority to U.S. Provisional Application No. 62/139,025, filed on Mar. 27, 2015, the disclosure of which is incorporated herein by reference in its entirety.

FIELD

This technology relates to a gown for a patient that provides privacy to parts of the body. In particular, the technology relates to a gown well-suited for movement and rehabilitation settings, as well as other settings.

BRIEF DESCRIPTION OF THE DRAWING FIGURES

DETAILED DESCRIPTION

Figure 2:
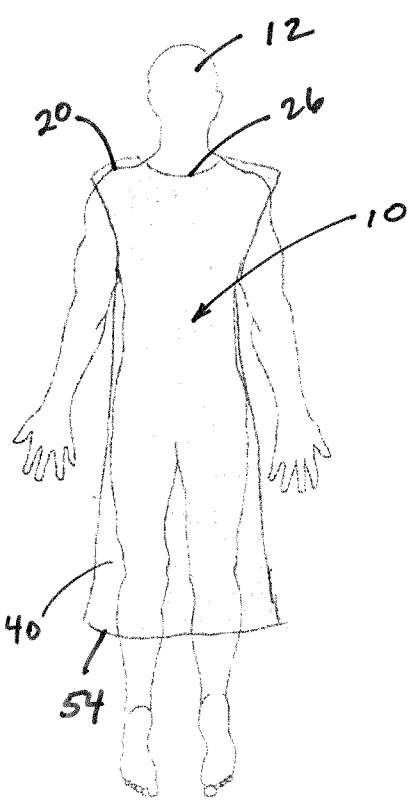
FIG. 2 is a rear view of the assembled example privacy gown of FIG. 1.
Figure 1:
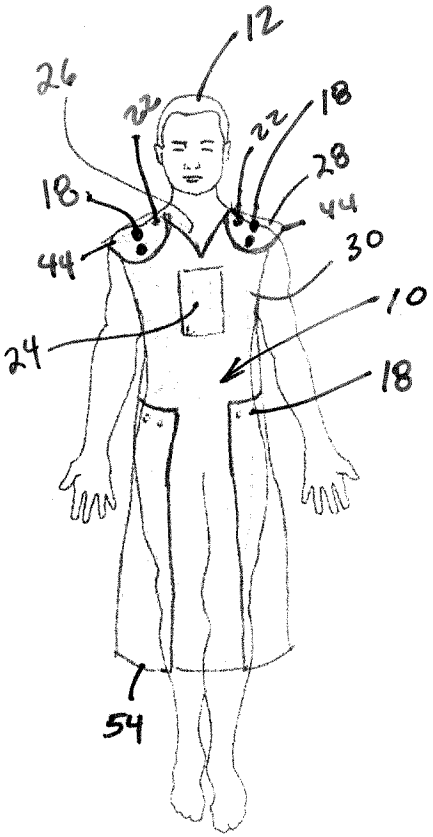
FIG. 1 is a front view of an assembled example privacy gown positioned on a patient's body.
Figure 4:
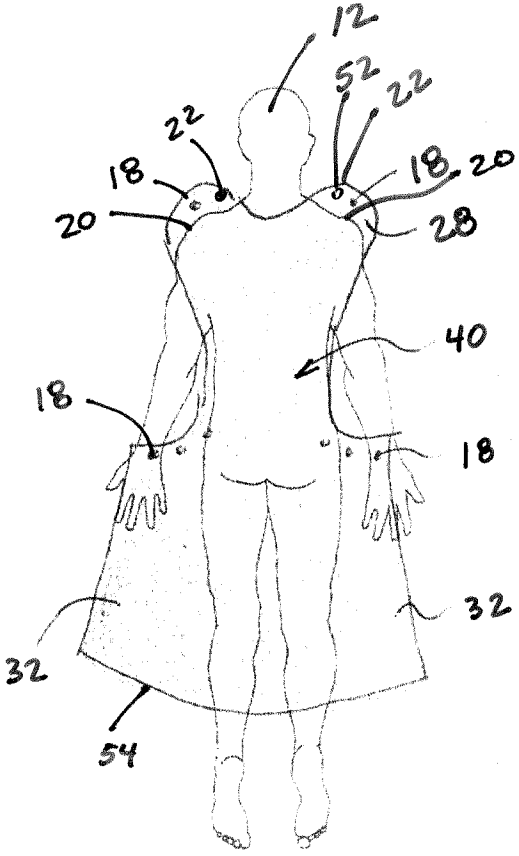
FIG. 4 is a rear view of a rear portion of the example privacy gown of FIG. 1 positioned over a body of a patient.
Figure 3:
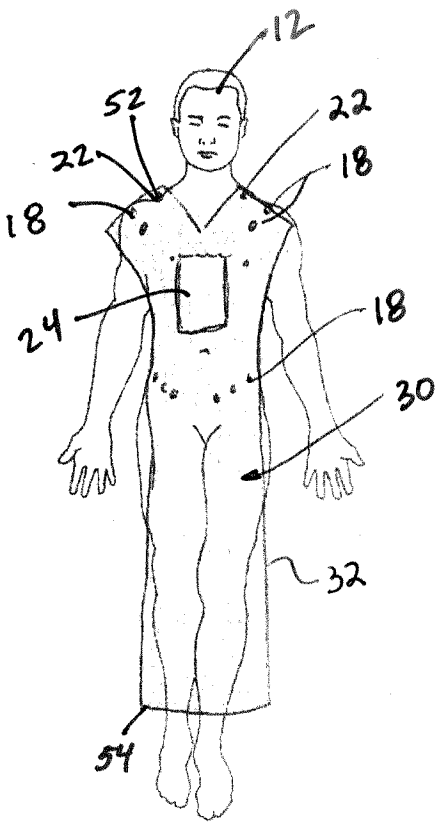
FIG. 3 is a front view of a front portion of the example privacy gown of FIG. 1 positioned over a body of a patient.

The example privacy gown 10 is provided in order to address issues with patient privacy. Conventional patient gowns that are used in hospitals and doctor's offices open in the rear of the gown and are closed with the use of fabric ties. These ties are in the back and on the sides of the gown and not easily accessible in many cases. Often, a patient's back side is exposed, at least in part, due to the configuration of the gown. This makes it difficult for a patient to walk around, unless they also use a robe or a second gown to cover the rear of the first gown.

The example gown 10 described herein addresses the issue of exposure by providing a fully adjustable gown 10 that avoids exposure of the back side of the patient 12. In addition, the example gown 10 provides a significant amount of body coverage in order to ensure the privacy of the patient 12. The example gown 10 permits a patient 12 to be on-the-go without fearing exposure and is well-suited for all types of hospital and patient usage, but is particularly well suited for acute rehabilitation patients, for skilled nursing facility patients, or for the acute hospital orthopedic patient. The gown 10 will also function well for medical/surgical patients 12 in the acute hospital, where the goal is active mobilization as soon as is medically appropriate.

Hospital gowns need to be affordable and durable since they will be washed hundreds of times over their useful lives. The example privacy gown 10 described herein uses substantially the same amount of fabric as the conventional gown that is most widely distributed today. The example privacy gown 10 also uses substantially the same amount of "notions," such as seam binding, thread, snaps or snap tape, and takes a comparable amount of time to manufacture. The example gown 10 also launders the same as the conventional gown. The gown 10 is typically not "faced," which saves on manufacturing costs. Seam or edge bindings 14 may be used to strengthen the edges and preserve the shape of the gown 10. Hems 16 can be made at the fabric's manufactured edge, if desired, in order to save on manufacturing costs associated with hemming. The binding 14 may extend along part or all of the length of the gown. The binding 14 may be positioned around the neck opening 26. The binding 14 may be positioned around the arm openings. The entire edge of the gown 10 could include an edge binding 14.

Figure 14:
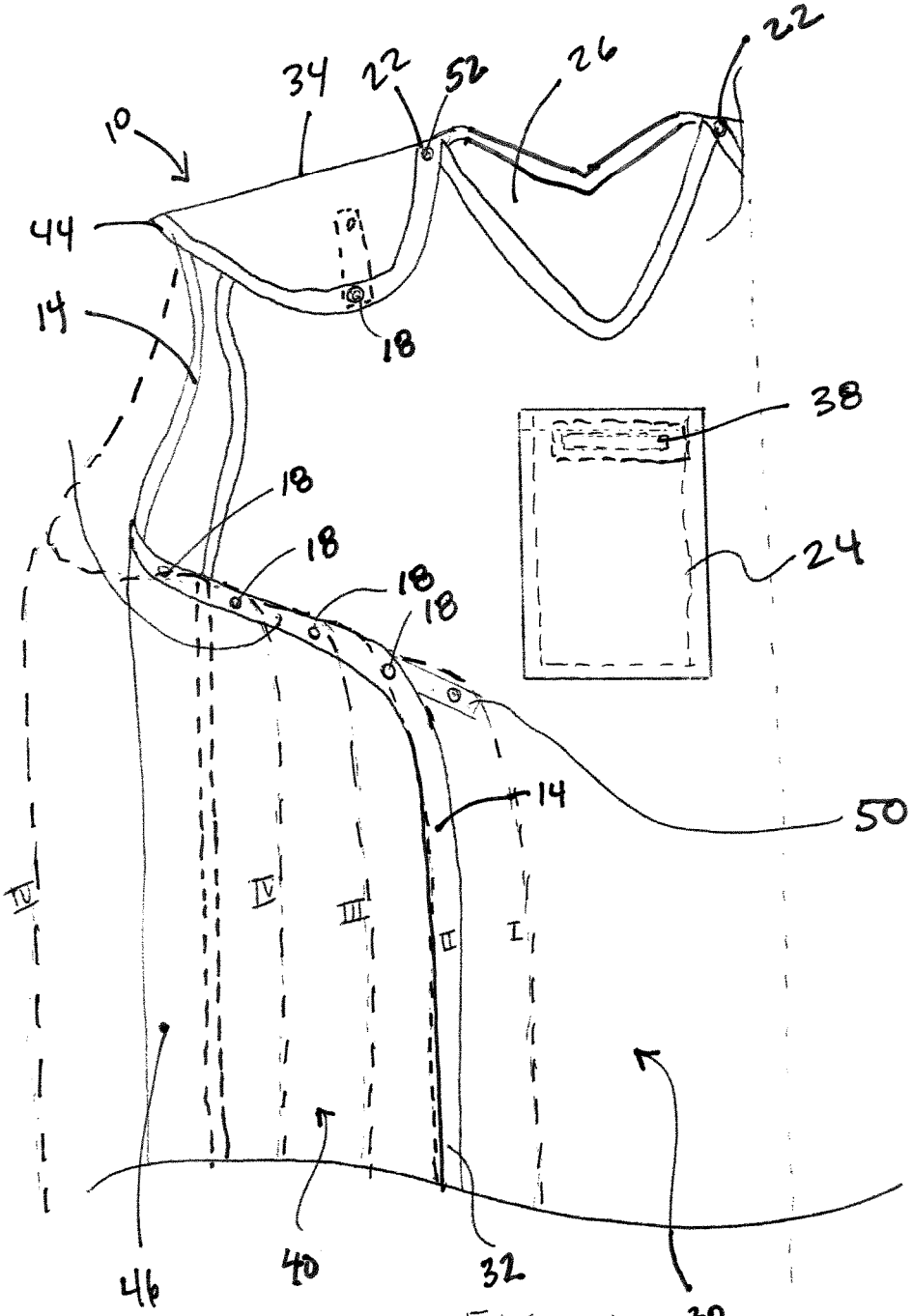
FIG. 14 is a schematic of part of the example privacy gown showing a right side of the gown in an assembled position, with the various widths of the gown being evident.

Currently, most hospitals stock gowns in two sizes, regular and bariatric. The example drawings, shown in FIGS. 1-15, depict the regular size. The example gown 10 may be suited for some bariatric patients 12 at the lower end of the bariatric patient weight scale due to its adjustability. The proportions of the example gown's 10 basic parts are scalable to a bariatric size or to a pediatric size. The example gown 10 is adjustable to provide multiple sizes, as shown in FIG. 14. These sizes are shown by roman numerals I, II, III, and IV, as will be described in greater detail below.

The example gown 10 provides a minimal amount of fabric that is non-confining. Many of the existing gowns have ties at the waist, sides, or backs of the gowns. These ties eventually wear and break off. The example privacy gown 10 described herein advantageously does not utilize ties.

The example privacy gown 10 provides excellent front body access to the patient 12 in the supine position and includes fasteners or connectors 18, 22 in places where a patient can reach them. The shoulder 20 of the patient 12 is more covered when the arm is in a sling because the shoulder portion 28 of the example gown 10 can be unsnapped while the neck snap 22 remains snapped. No hospital worker is needed to reach around the back of a seated patient 12 to tie a gown for them. If a patient 12 is side-lying in bed, the snaps 18, 22 can release easily to expose a patient's back. The side opening 46 of the gown 10 permits a catheter tube to side lie and be clipped across the patient's thigh more easily than with a rear opening gown.

The example privacy gown 10 provides for a V-neck shape in the front to diminish "choking" the patient 12 when the patient 12 moves in bed. Other shapes for the neck hole may alternatively be used. Patients 12 do not have to expose their back sides when transferring, standing, or walking. The gown 10 has a centrally placed pocket 24 that is located in the center of the chest for use with devices such as cardiac telemetry monitors. The example gown 10 is useful in the context of Physical Therapy or nursing of a child.

Because the example privacy gown 10 is sleeveless, the gown sleeve will not hamper the placement of crutches against the upper side chest wall of a patient 12. The gown 10 separates easily for a patient 12 when sitting on a commode or toilet. Since the example gown 10 allows more free leg movement because of the front/side openings, the gown 10 will typically not restrict stride length when walking.

The example gown 10 is well suited for use by actively rehabilitating in-house hospital patients 12. In today's world, this includes almost all acute hospital patients 12, acute rehabilitation patients 12, and many skilled level patients 12. The example gown 10 provides superior access to the body for general nursing procedures, privacy and increased freedom of movement while ambulating and exercising, and better visual and hands-on access for PT when the patient 12 is wearing various post orthopedic surgery stabilizing devices or post-surgical dressings.

Referring to the figures, the example privacy gown 10 has two parts, a front panel 30 and a rear panel 40. The front panel 30 covers the front of a patient's 12 body while the rear panel 40 covers the rear of a patient's 12 body. The rear panel 40 also wraps around the sides of the patient's 12 body and overlaps the front panel 30 of the gown 10 at the sides 32 and top end 34 thereof. This overlap may occur at both the shoulders 20 and at the sides or hips of a patient 12.

The front panel 30 of the gown 10 is formed from a single piece of fabric and has connectors 18, 22 for attaching the front panel 30 to the rear panel 40 of the gown 10. The rear panel 40 of the gown 10 is also formed from a single piece of fabric and has connectors 18, 22 for mating with connectors 18, 22 that are coupled to the front panel 30. Snaps or other fasteners or connectors may be used as the connectors 18, 22.

The front panel 30 is attached to the rear panel 40 by neck, shoulder and side/waist snaps 18, 22. The front panel 30 includes two snaps 18 in a line at the shoulder portion 28 and four snaps 18 in a line at each side of the waist. A neck snap 22 is also provided at either side of the neck opening 26. The shoulder, side, and neck snaps 18, 22 are configured for coupling with mating snap backs 18, 22 on the rear panel 30.

The rear panel 30 includes two snap backs 18 in a line at the shoulder portion 28 and four snap backs 18 in a line at each side of the waist. These snaps 18 make the gown 10 adjustable. There is another snap back 22 at the neck of the rear panel 30. In the example shown, only one snap 22 is provided at either side of the neck in order to define a constant sized neck hole. However, as with the other snaps, more than one snap could be provided at either side of the neck hole in order to allow for adjustability at the neck. Moreover, the snaps and snap backs could be switched from the front to the rear panel, or other types of connectors could be used.

As previously described, the front panel 30 includes a pocket 34 that is located mid-chest. This pocket may be rectangular or another shape. The pocket may be used for holding a telemetry unit. The upper end 36 of the pocket 34 may be hemmed. A slit or opening 38 may be provided through the first panel 30 behind the pocket 34 in order to permit leads from the body to extend through the slit 38 to the telemetry unit held in the pocket 34. The pocket 34 in the center of the chest makes it easier for women to carry their monitors without them falling out over the breasts when the woman bends forward. The slit 38 may be reinforced by hemming or by binding, if desired. More than one slit or a different type of opening may be provided, as needed.

The combination of the front and back panels 30, 40, due to the ample amount of fabric at the sides, allows for a side wrap around that does not reveal the body of the patient 12 while walking. At the same time, the gown 10 gives complete side, and therefore back, access to medical personnel with the quick unsnapping of the snaps 18, 22. In addition, the snaps 18, 22 at the shoulder portion 28 provide quick chest access.

The back panel 40 of the example gown 10 utilizes snap tops while the front panel 30 uses snap backs. The opposite could be true, if desired. The back panel attaches to the front panel 30 by snaps only. No ties are required.

Sleeves 44 for the example gown 10 are cap-shaped when the gown 10 is assembled. This provides better arm access than with conventional gowns. Studies show that patients 12 complain about being too warm in the hospital, not too cold. The sleeves may be any shape desired. In addition, the gown 10 may be sleeveless.

Patients 12 who utilize crutches often find that the gown 10 gets in the way. The example gown 10 does not have restricting arm holes. In addition, the example gown 10 provides for adjustability of the arm holes, which can be accomplished by moving the arm hole snap 18 at the shoulder portion 28, and/or by adjusting the width of the gown 10 at the waist.

As is evident, all the gown 10 adjustments and closure mechanisms are located in the front of the gown 10. This allows the patient 12 the easiest possible access.

The gown 10 at the shoulder portion 28 allows for easier blood pressure cuff and IV placement and provides easy release when lying in bed. The gown 10 at the shoulder portion 28 also provides quick access to the total chest of a patient 12 in the event of an emergency. The gown shoulder design is particularly useful in cases of total shoulder replacement surgery, where a large sling is often required and needs to be adjusted and occasionally removed for range of motion and pendulum exercises. The example gown 10 will cover a patient 12 more comfortably because the gown 10 covers the body adequately over the bulky sling.

The side openings 46 of the example gown 10 allow for the large back panel 40 to always cover the back of the patient's 12 body. This removes the need for medical personnel to reach behind the seated patient 12 who is about to stand to tie the cumbersome and often absent back ties. Even then, conventional gowns still often required the medical personnel to pull the gown over the patient's 12 backside once they are fully upright in order to attempt to ensure some privacy. The side openings 46 of the example gown 10 allow superior access for catheter tubes and thigh clips and allow the same access to the back of the body when the patient 12 is side lying, as compared to the conventional gown. The one piece back panel 40 and the absence of ties means that a patient 12 has no uncomfortable ties or bunched material underneath their backs when lying in bed in the supine position. All immobilizers, long leg braces, total hip abduction pillows and fixation devices will be easier to monitor due to the configuration of the example gown 10.

The front panel 30 of the example gown 10 can be tucked between the legs of a patient 12 for privacy when the patient 12 is on a CPM machine, doing a bridge exercise in bed, or as part of a transfer, and for mat and sitting exercises. This makes the working leg(s) more free to move. The Physical Therapist can also have better joint observation of the knee or hip when the patient 12 is moving or exercising without compromising a patient's 12 privacy.

In use, the example gown 10 can be assembled at the shoulder portion 28 and then draped over a patient's head. The sides can then be snapped after the gown 10 is placed over the patient's head. Alternatively, an example privacy gown 10 can be assembled at the waist and then placed over a patient's 12 head. If desired, the patient 12 can unsnap one or both sides for greater comfort in bed. The shoulder snaps 18 and neck snaps 22 are in the front, which permits a patient 12 to unsnap them, when desired. Because of the design of the example gown 10, unsnapping of one shoulder snap 18 will not reveal an entire side of the chest. It will only reveal the shoulder 20 area since the neck snap 22 will still be attached.

Because the sides of the back panel 40 overlap the front panel 30 when the snaps 18, 22 are attached to one another, the gown 10 is less likely to gape open. This provides additional privacy over other known gowns.

The snaps 18, 22 on the example gown 10 may be associated with a snap tape 50 that is sewn to the gown 10. The snap tape 50 may be positioned on a front side of the respective panels 30, 40 or on a rear side of the respective panels 30, 40, depending upon required functionality. The edges of the gown 10 may be bound with a binding tape 14. In some areas, binding 14 may be preferable in order to maintain the shape of the gown 10 and to provide reinforcement areas for the snaps 18, 22. Other areas of the gown 10 may be simply hemmed. A reduction in the amount of binding 14 or the number of snaps 18, 22 may lower the price point for the gown 10. The snaps 18, 22 allow the gown 10 to be fixed in position, but also allow for removal of the gown 10 by unsnapping the snaps. As such, the snaps fixedly attach the parts of the gown 10 together in a removable manner.

The front and back panels 30, 40 could be color coded in order to permit for easier gown 10 piece identification and assembly. This could be accomplished by utilizing different fabric colors, different trim colors, different colors in the areas of the snaps, different surface patterns, or the like. The snaps themselves could be different colors. For example, in one example, the neck snap 52 and snap back 52 on the right side of the gown front and rear panels 30, 40 could be a different color than the other snaps. The neck snaps 52 could be red while other snaps 18, 22 could be silver or white or some other common color.

Although not shown, other pockets could be positioned on the gown 10, as well as other apertures.

Figure 6:
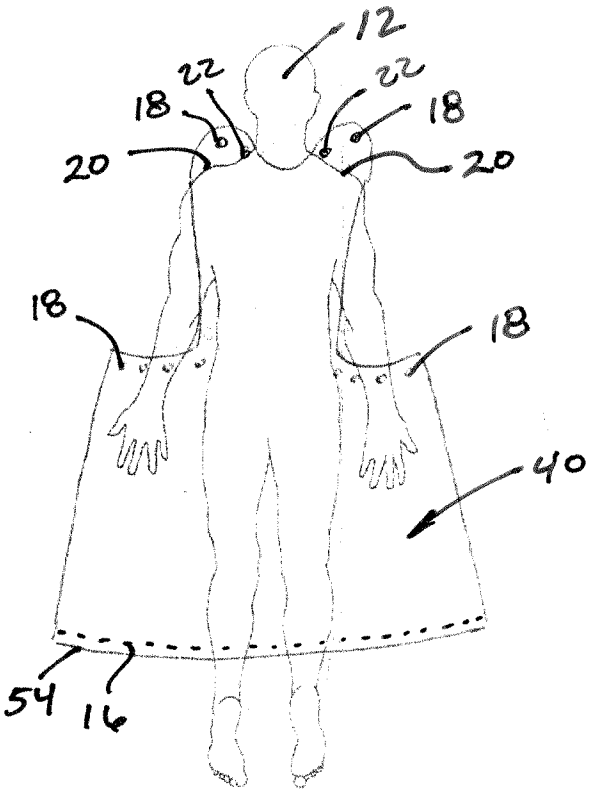
FIG. 6 is similar to FIG. 4, but shows some example dimensions for the rear portion of the example privacy gown.
Figure 5:
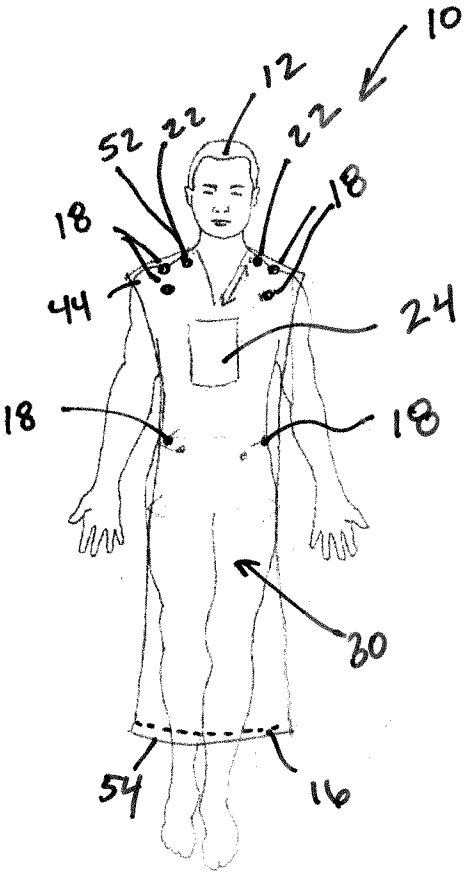
FIG. 5 is similar to FIG. 3, but shows some example dimensions for the front portion of the example privacy gown.
Figure 7:
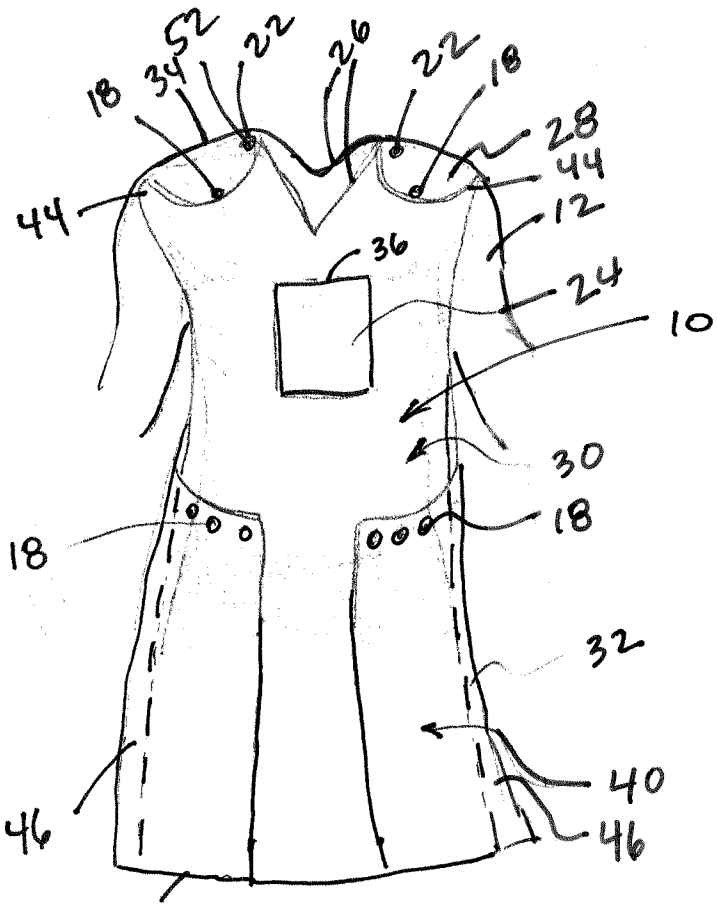
FIG. 7 is a close up view of the example privacy gown of FIG. 1 installed on the torso of a patient.

FIGS. 5 and 6 show some approximate dimensions that could be utilized for one example of the privacy gown 10. These dimensions represent but one embodiment of the gown 10 and are provided for illustration purposes—the gown 10 not being limited to these specific measurements.

Figure 9:
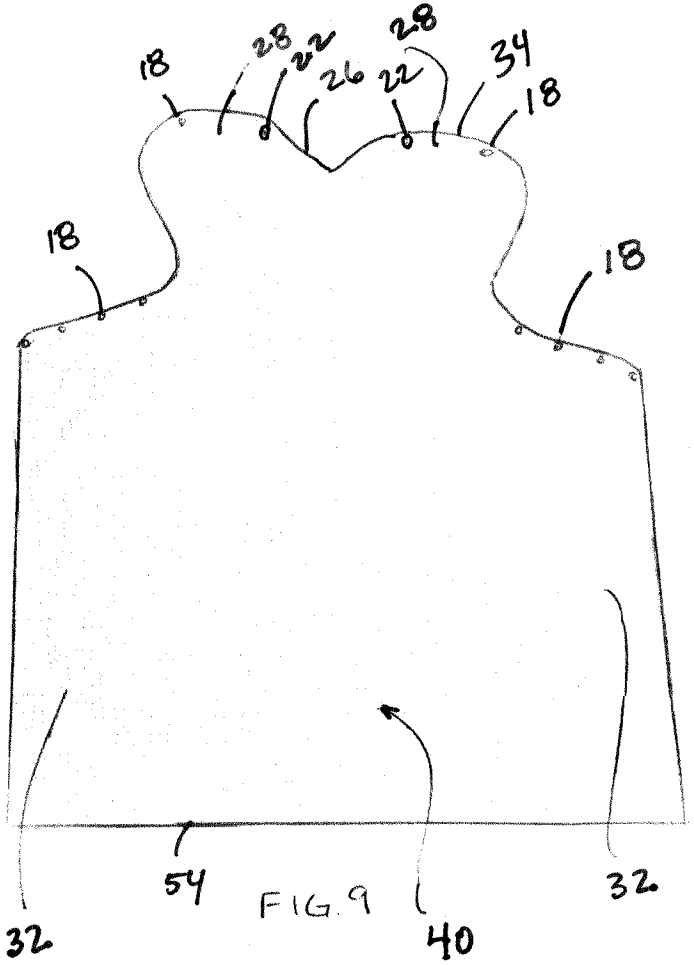
FIG. 9 is a plan view of a rear portion of the example privacy gown of FIG. 1.
Figure 8:
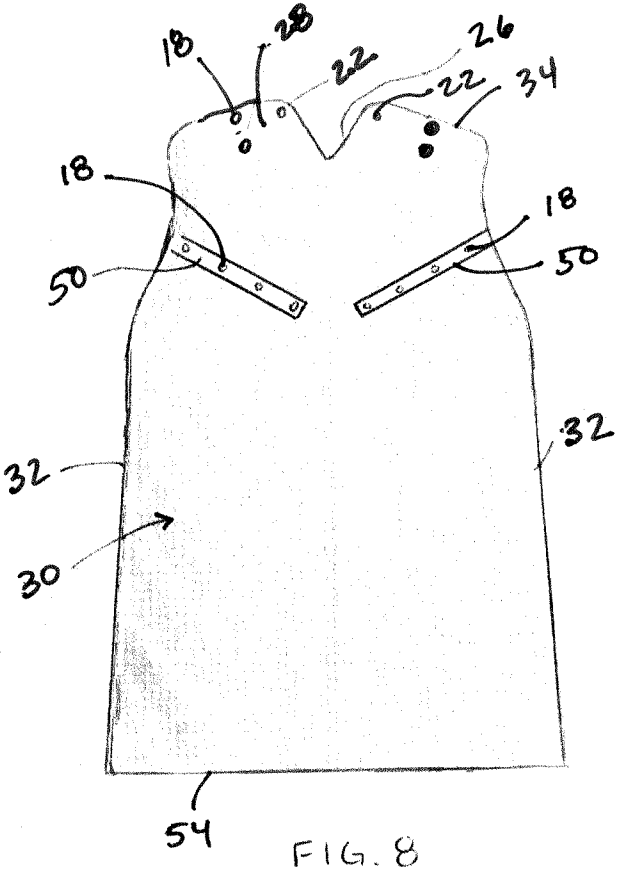
FIG. 8 is a plan view of a front portion of the example privacy gown of FIG. 1.
Figure 10:
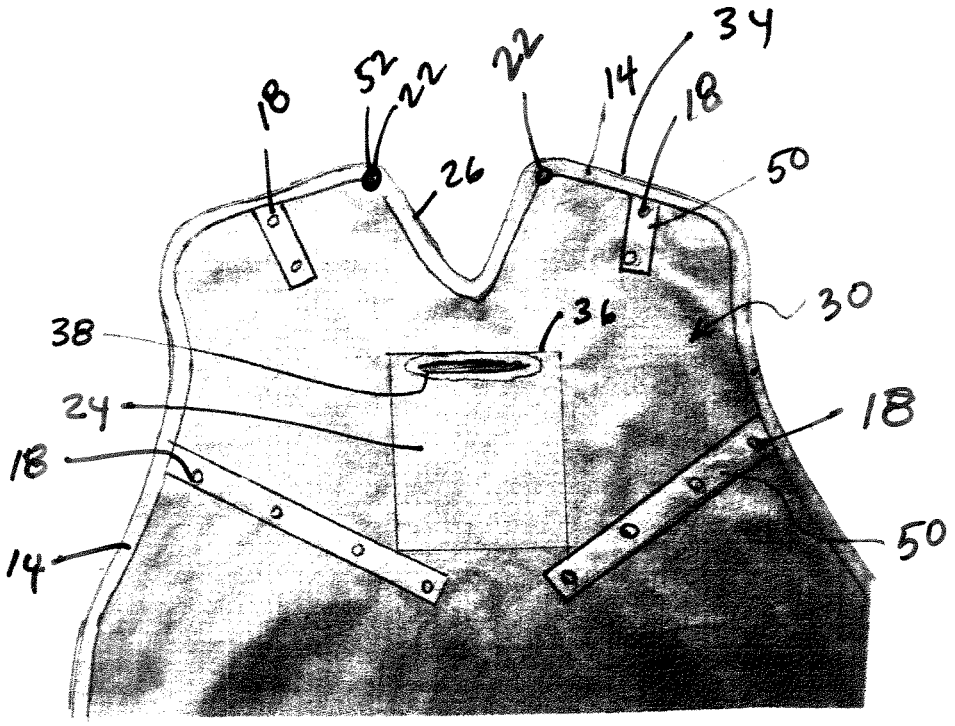
FIG. 10 is a plan view of a back side of the front portion of the example privacy gown of FIG. 1.
Figure 11:
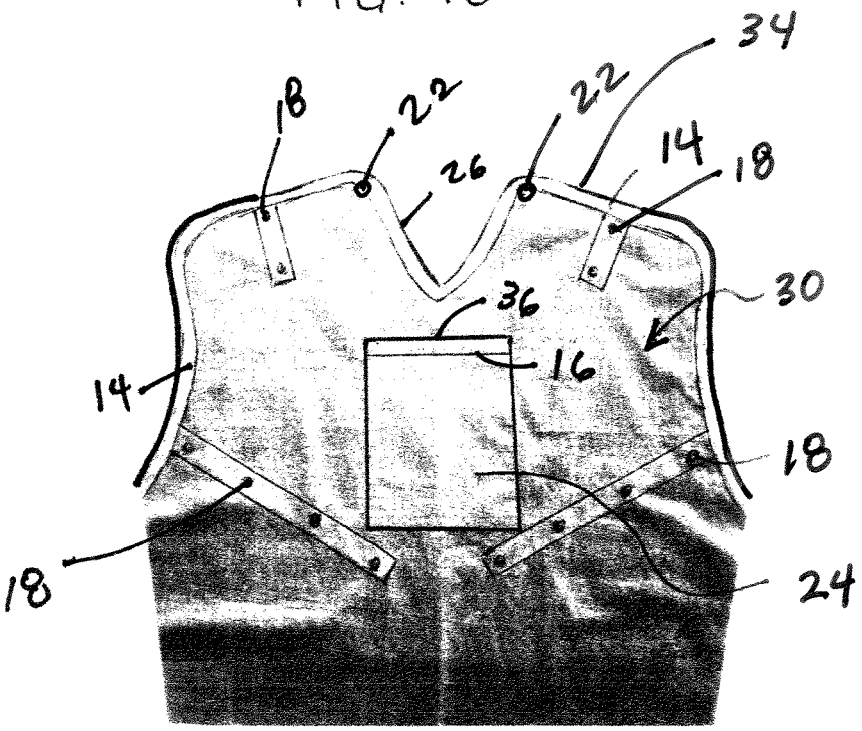
FIG. 11 is close up plan view of the front side of the front portion of the example privacy gown of FIG. 1.
Figure 12:
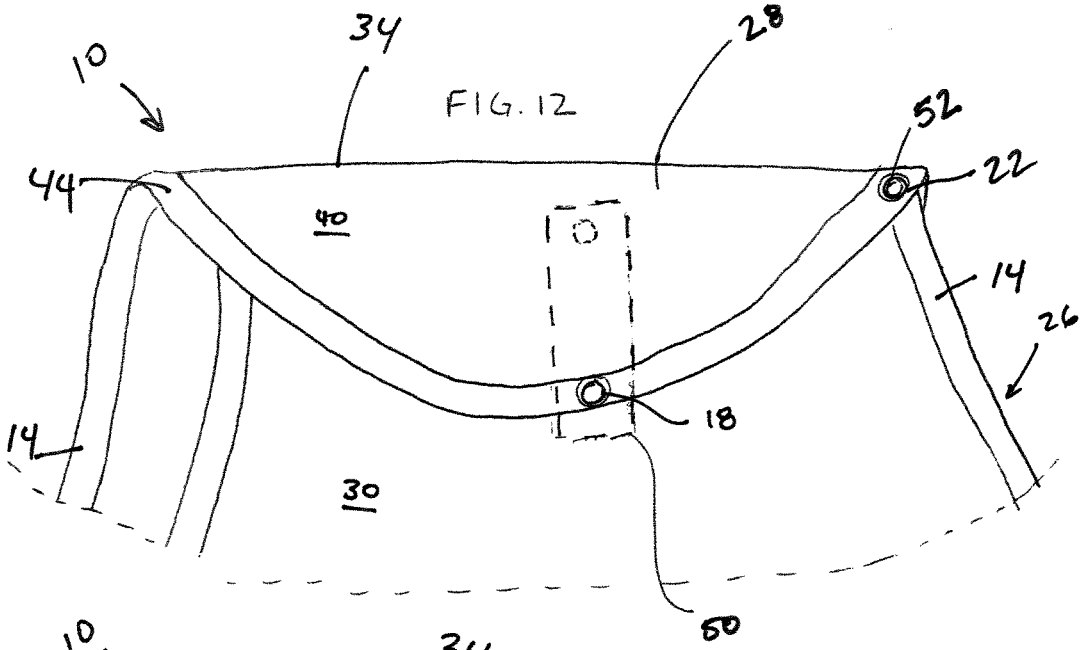
FIG. 12 is a schematic showing the shoulder portion of the front and rear portions of the example privacy gown in an installed first position.
Figure 13:
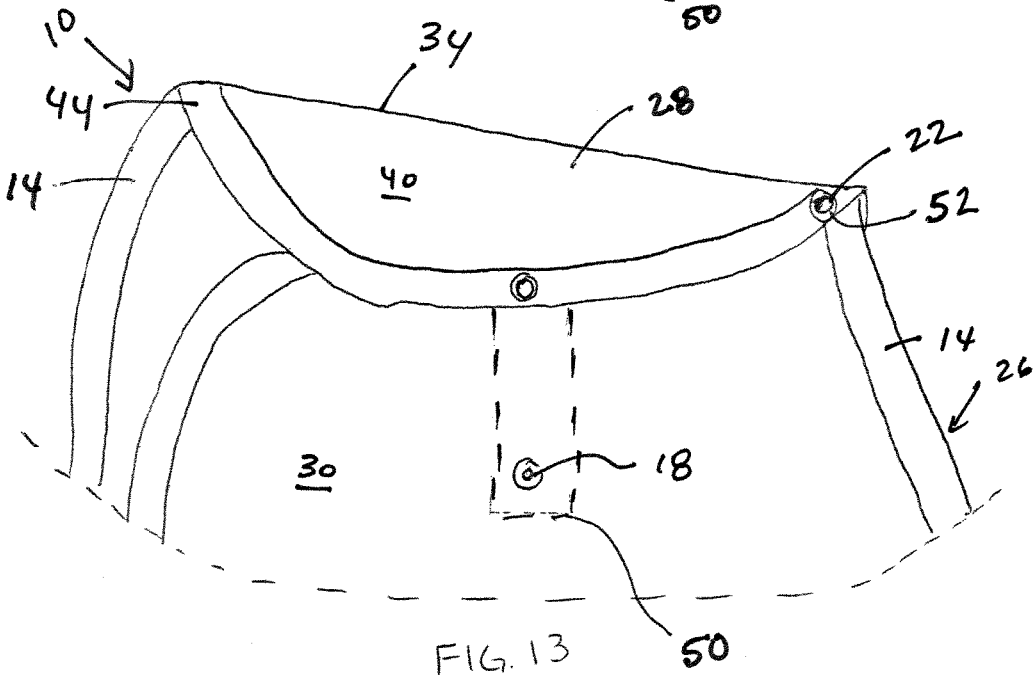
FIG. 13 is a schematic showing the shoulder portion of the front and rear portions of the example gown in an installed second position, that has a larger arm opening than a first position.

FIGS. 8 and 9 show patterns for the gown 10, with the gown 10 having rounded edges in the vicinity of the neck and arms. In addition, the gown 10 widens slightly towards the bottom 54. It may be desirable to have a gown 10 that does not widen in order to permit side by side patterns of material to be produced, reducing the amount of cutting necessary in the manufacturing process.

FIG. 14 shows different sizes for a single gown 10. Size I is the smallest size, Size II is slightly wider than Size I, Size III is slightly wider than size II, and Size IV is the widest size. The sides of the back panel 40 overlap a significant portion of the front panel 30 when in each of these positions. At size I, a majority of the front of the gown 10 is overlapped or covered—e.g., greater than about 50% of the front of the gown 10 is covered. For size IV, approximately 10% of the front sides of the gown 10 are overlapped or covered. If desired, the left and right sides of the back panel 40 could substantially meet in the middle of the front panel 30 in order to provide the greatest amount of adjustability. More or less than four levels of adjustability width-wise could be provided, if desired. For example, at Size I, about 50%, 60%, 70%, 75%, 80%, 90%, 95% or 100% of the width of the front panel 30 may be covered where the back panel 40 overlaps the front panel 30. At size IV, about 5%, 10%, 15%, or 20% of the front panel 30 is covered where the back panels 40 overlap the front panel 30. At sizes II and III, the amount of overlap is proportionally lowered relative to the difference between the coverage at Size I and Size IV. Other sizes and combinations of sizes may be utilized, as desired. The gown 10 may have a single size, if desired.

In order to select Size I, all four snaps 18 at the waist may be engaged. Alternatively, the inner most snap on the front panel 30 is engaged with the outermost snap on the back panel 40. Other snaps may also be engaged of the four snaps 18 at the waist, as long as the inner most snap of the front panel 30 aligns with the outermost snap of the back panel 40. In order to select Size II, three of the snaps 18 may be engaged, with the inner most snap of the front panel 30 being free and the inner most snap on the rear panel 40 being free. In order to select Size III, two of the snaps may be engaged, with the two inner most snaps of the front panel 30 being free and the inner most two snaps on the rear panel 40 being free. In order to select size IV, the outermost snap on the front panel 30 engages the first, outermost snap on the back panel 40. More or less than four snaps 18 at the waist in a row may be used. If desired, only a single snap could be provided on the back panel 40. In addition, while only one row of snaps 18 is shown, multiple rows of snaps 18 could be provided in order to ensure greater likelihood of the snaps 18 staying in place. For example, a first row of snaps could be positioned above a second row of snaps in substantially parallel relation to one another on each side of the front panel 30.

Figure 16:
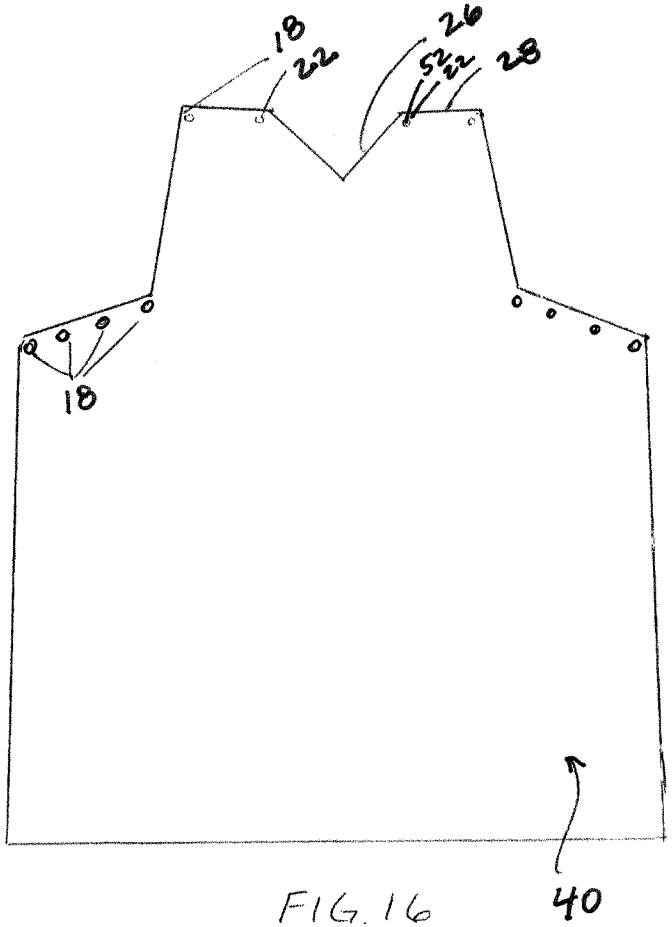
FIG. 16 is an alternative rear portion of an example privacy gown, which may be for use with the front portion shown in FIG. 15.
Figure 15:
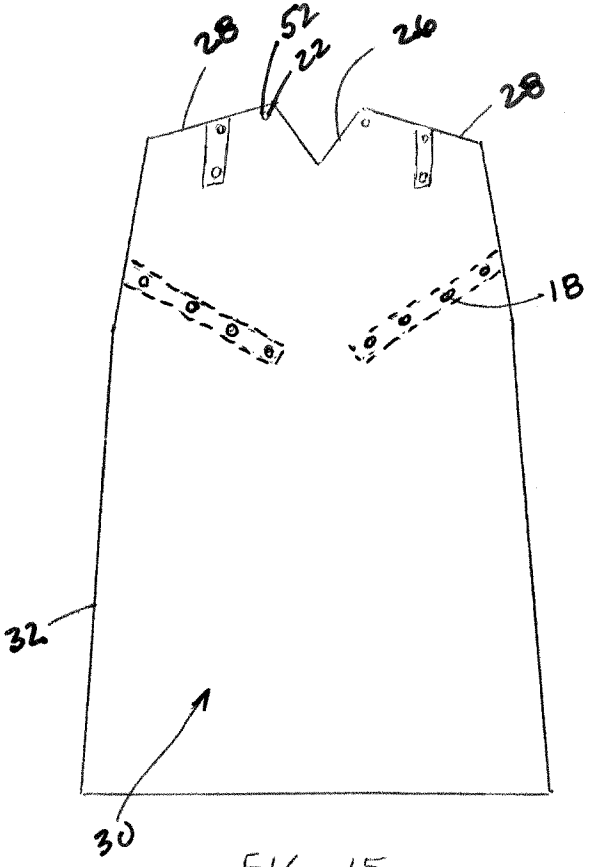
FIG. 15 is an alternative front portion of an example privacy gown.

FIGS. 15 and 16 show an alternative example privacy gown 10 that has a similar, but more geometric shape than the examples shown in FIGS. 1-14.

The shape of the front and rear panels 30, 40 may be optimized for efficiency purposes in terms of usage of a sheet of material. The shape of the front and rear panels 30, 40 may also be optimized for efficiency in manufacture and assembly.

It should be noted that the embodiment shown in FIGS. 1-7 is different from the embodiment shown in FIGS. 8-16. In particular, the embodiment of FIGS. 1-7 has a greater length for the arm hole that is caused by the overlapping flap of the back panel 40 being shorter, or lower, than the design shown in FIGS. 8-16. As is evident, the dimensions and size of the various parts of the design can be modified such that either more or less of the side of the torso is covered.

The gown 10 may have a shaped neck, such as a rounded neck opening 26 or a v-neck neck opening 26. The front panel 30 may have a v-neck and the rear panel 40 may have a v-neck. Alternatively, other shapes may be used, as desired.

The front and rear panels 30, 40 are shown as being separate from one another. Alternatively, if desired, the front and rear panels could be coupled together at a point where one of the neck snaps 22 are located in the above examples so as to form a single panel. For example, the red snap discussed above could be replaced with a section of fabric. Alternatively, red snap tape could be used instead of a red snap.

While snap tape 50 is shown in the figures, individual snaps may alternatively be used. Snap tape 50 may also be substituted for any individual snaps that are shown. In addition, other types of connectors may be used, as known by those of skill in the art. See, e.g., http://www.ykkfastening.com/products/types/t_snap_button.html; http://www.ebow.com/info_8295011_types-fasteners-clothing.html; http://www.cooperativepatentclassification.org/cpc/definition/A/definition-A44B.pdf.

A privacy gown includes a first panel, a second panel, and a plurality of connectors. The second panel has a different size and shape from the first panel. The plurality of connectors are coupled to both the first and the second panels for removably and fixedly coupling the first and second panels together in an assembled position. The second panel has a portion with a width that is greater than a width of the first panel along at least part of a length of the second panel. The second panel overlaps the first panel along the sides thereof when in an assembled position. The second panel has at least two different width positions for fixing the width of the privacy gown during use, with each of the at least two different width positions providing overlapping of the second panel with the first panel so that the gown will not gape open in the area of overlap.

The second panel may have a portion with a length that is greater than a length of the first panel at an upper end thereof. The second panel overlaps the first panel along the upper end thereof when in an assembled position.

The privacy gown has an adjustable armhole size provided by the overlapping upper portion of the second panel, which provides at least two different armhole sizes positions for fixing the armhole size of the gown when in an assembled position. The second panel overlaps the first panel in both of the two different armhole size positions.

The connectors may include snaps associated with the at least two different armhole sizes and at least one neck snap. When a single neck snap is provided at each side of a neck opening 26 of the gown, the neck snap can remain snapped with the shoulder snaps being unsnapped to reveal the shoulder 20 of the patient.

The first panel may be a front panel for positioning against the front of a person and the front panel may have a neck opening that is substantially V-shaped. The first panel may be a front panel for positioning against the front of a person and the second panel may be a rear panel for positioning against the back of a person.

The connectors may be snaps. The snaps may be positioned on a tape that is coupled to the panels. The second panel may be fixedly attached to the first panel in multiple removable locations in order to cover a range of the first panel with the second panel that ranges from about 75% to about 10%.

In another embodiment, a privacy gown includes a front panel, a rear panel, and at least one non-strap connector. The rear panel is configured to overlap the front panel at a left and a right side. The at least one connector is positioned at a top end of the front panel for mating with at least one connector of the rear panel.

The front panel has a top end with a left side and a right side. The rear panel has a top end with a left side and a right side. The at least one connector may include at least two connectors at the left side of the front and rear panels and at least two connectors at the right side of the front and rear panels.

The first connector on the right side of the front panel and a mating first connector on a right side of the rear panel may have a color that is different from a color of other connectors on the front and rear panels. The first connector of the front panel and the first connector of the rear panel may have the same color that is red. The colored connector can be used to assist a person in assembling the gown, since the user knows that the red connector 52 from the front panel 30 connects to the red connector 52 from the rear panel 40.

The front panel may include a left side and a right side and the at least one connector that is positioned on both the left side and the right side of the front panel. The at least one connector may include a first and a second connector positioned at a top end of the front panel and a neck connector positioned inwardly of the first and second connector positioned at the top end of the front panel, with the rear panel having mating connectors. The neck connectors on the right side of the gown may comprise a snap. The neck connectors on the right side of the gown may be formed from a contiguous piece of fabric that is joined to the front and rear panels.

In another embodiment, a privacy gown includes a front panel, a rear panel, and at least one connector positioned at the top end of the front panel for mating with at least one connector of the rear panel. The front panel has a top end with a left side and a right side for association with corresponding shoulders 20 of a patient. The rear panel is configured to overlap the front panel at a left and a right side thereof. The at least one connector is positioned at the top end of the front panel for mating with at least one connector of the rear panel. The front panel is coupled to the rear panel at the right side thereof or the left side thereof while still providing adjustability to the size of a shoulder 20 and/or arm of a patient.

The gown may have any dimensions desired. In one example, the rear panel of the gown has a neck opening of about 8 inches to about 8.5 inches wide and a drop of about 7.5 inches. The rear panel may have a width at the waist of about 22 inches and a width at the hips of about 40-45 inches. One width at the hips may be around 41.5 inches or 41.75 inches. The width of the rear panel at the bottom end thereof may be around 48 to 50 inches. One possible width at the bottom of the rear panel is around 48.5 inches or 50 inches. The front panel neck opening may be around 6 inches wide and the width of the top end at each shoulder of the patient may be around 6 to 7 inches. The connectors 18 at the shoulder on the front panel may be about 2 inches or 2.5 inches apart, with the connectors being aligned vertically. Alternatively, the connectors may be aligned at an angle. The width of the front panel at the waist of the patient may be about 21-23 inches, with one example width being about 21.5 inches. The width of the front panel at the hips of a patient may be about 25 to 26 inches. The length of the front panel may be around 40-45 inches from the top end at the neck connector to the bottom end, with one example length being about 43 inches. The length of the front panel may be around 41 inches as measured from the top connector 18 to the bottom of the front panel. The telemetry pocket may have a width of about 5.5 inches and a height of about 7.5 inches.

The term "substantially," if used herein, is a term of estimation.

While various features of the claimed invention are presented above, it should be understood that the features may be used singly or in any combination thereof. Therefore, the claimed invention is not to be limited to only the specific embodiments depicted herein.

Further, it should be understood that variations and modifications may occur to those skilled in the art to which the claimed invention pertains. The embodiments described herein are exemplary of the claimed invention. The disclosure may enable those skilled in the art to make and use embodiments having alternative elements that likewise correspond to the elements of the invention recited in the claims. The intended scope of the invention may thus include other embodiments that do not differ or that insubstantially differ from the literal language of the claims. The scope of the present invention is accordingly defined as set forth in the appended claims.

What is claimed is:

1. A privacy gown comprising:

a front panel having an upper end, a lower end, and a middle section, with the middle section being in the vicinity of a waist of a patient when in an assembled position, with the front panel having a width in the middle section that is less than a width of the front panel at the upper end and lower end, and the width of the front panel at the upper end is smaller than a width of the front panel at the lower end thereof;

a rear panel having a different size and shape from the front panel;

a plurality of connectors coupled to both the front and rear panels for removably and fixedly coupling the front and rear panels together in an assembled position;

wherein the rear panel has a width at a lower end thereof that is greater than a width of the lower end of the front panel, with the rear panel overlapping the front panel along the sides thereof at the lower end thereof when in an assembled position, and the rear panel has at least two different fixed width positions for fixing the width of the privacy gown during use, with each of the at least two different width positions providing the rear panel to overlap the front panel so that the gown will not gape open in the area of overlap, wherein, when in an assembled position, the rear panel extends over the shoulders of an individual and overlaps the front panel at the upper end thereof to create an overlapping upper portion such that the rear panel extends downwardly over and down in front of the shoulders;

wherein the privacy gown is sleeveless.

2. The privacy gown of claim 1, wherein the rear panel has a length that is greater than a length of the front panel to permit the rear panel to overlap and extend downwardly over the upper end of the front panel.

3. The privacy gown of claim 2, wherein the privacy gown has an adjustable armhole size provided by the overlapping upper portion of the rear panel, which provides at least two different armhole size positions for fixing the armhole size of the gown when in an assembled position, with the rear panel overlapping the front panel in each of the at least two different armhole size positions.

4. The privacy gown of claim 3, wherein the connectors include shoulder snaps associated with the at least two different armhole sizes and at least one neck snap.

5. The privacy gown of claim 4, wherein when a single neck snap is provided at each side of a neck opening of the gown, the neck snap can remain snapped with the shoulder snaps being unsnapped to reveal the shoulder.

6. The privacy gown of claim 1, wherein the front panel is for positioning against the front of a person and the front panel has a neck opening that is substantially V-shaped.

7. The privacy gown of claim 1, wherein the front panel is for positioning against the front of a person and the rear panel is for positioning against the back of a person.

8. The privacy gown of claim 1, wherein the connectors are snaps.

9. The privacy gown of claim 8, wherein the snaps are positioned on a tape that is coupled to one or more of the front and rear panels.

10. The privacy gown of claim 1, wherein the rear panel fixedly attaches to the front panel along the sides thereof in multiple removable locations in order to cover a range of the front panel with the rear panel that ranges from about 75% to about 10%.

11. The privacy gown of claim 1, wherein the front and rear panels have a left and a right side that are associated with a left and right side of a patient when in an assembled position, and further comprising a series of connectors coupled to the front and rear panels in the vicinity of a waist of a patient when in an assembled position, with the series of connectors being arranged in a line that radiates from an outer edge of the left and right sides of the panels and extends inwardly towards a center of the respective panels, with the connectors being positioned on both the left and right sides of the front and rear panels.

12. A privacy gown comprising:

a front panel having an upper end, a middle section, and a lower end, with a width of the front panel at the upper end being less than a width at the lower end of the front panel, and a width in the middle section being less than both the width at the upper end and the width at the lower end of the front panel;

a rear panel having an upper end, a middle section, and a lower end, said rear panel being configured to overlap the front panel at a left and a right side thereof at the lower end thereof, with the rear panel having a width at a lower end thereof that is greater than a width of the front panel at a lower end thereof, and a width in the middle section being less than both the width at the upper end and the width at the lower end of the rear panel;

at least one connector positioned at a top end of the front panel for mating with at least one connector of the rear panel.

13. The privacy gown of claim 12, wherein the front panel has a top end with a left side and a right side, the rear panel has a top end with a left side and a right side, and the at least one connector includes at least two connectors at the left side of the front and rear panels and at least two connectors at the right side of the front and rear panels.

14. The privacy gown of claim 13, wherein a first connector on the right side of the front panel and a mating first connector on the right side of the rear panel have a color that is different from a color of other connectors on the front and rear panels.

15. The privacy gown of claim 14, wherein the first connector of the front panel and the first connector of the rear panel have the same color that is red.

16. The privacy gown of claim 12, wherein the connectors comprise snaps.

17. A privacy gown comprising:

a front panel having a top end with a left side and a right side for association with corresponding shoulders of a patient;

a rear panel configured to overlap the front panel at a left and a right side thereof at both an upper end thereof in the vicinity of the shoulders of a user and at a lower end thereof in the vicinity of the hips and legs of a user;

at least one connector positioned at the top end of the front panel for mating with at least one connector of the rear panel, wherein the upper end of the front panel is coupled to the rear panel at the right side thereof or the left side thereof while still providing adjustability to the size of a shoulder and/or arm of a patient;

wherein the front and rear panels have a shape and width that is different from one another, and the front panel has a width at the top end that is smaller than a width of the front panel at a lower end thereof, and the rear panel has a width at a lower end thereof that is greater than a width at an upper end thereof; and wherein a series of connectors are coupled to the front and rear panels in a middle section of the front and rear panels when in an assembled position, with the series of connectors being arranged in a line that extends from an outer edge of the left and right sides of the panels and extends inwardly towards the center of the panel, with the connectors being positioned on both the left and right sides of the front and rear panels.

18. The privacy gown of claim 17, wherein the front panel has a neck opening and the rear panel has a neck opening, with the front panel neck opening being a substantially v-neck opening and the rear panel neck opening being a substantially v-neck opening.

* * * * *